United States Patent [19]

Frochaux

[11] B 3,984,054

[45] Oct. 5, 1976

[54] NOZZLE

[75] Inventor: Alain Frochaux, Boston, Mass.

[73] Assignee: Barry Wright Corporation, Watertown, Mass.

[22] Filed: May 27, 1975

[21] Appl. No.: 580,921

[44] Published under the second Trial Voluntary Protest Program on January 13, 1976 as document No. B 580,921.

Related U.S. Application Data

[63] Continuation-in-part of Ser. No. 500,647, Aug. 26, 1974, abandoned.

[52] U.S. Cl. ..... 239/424; 239/DIG. 7; 239/DIG. 21; 239/DIG. 22; 239/291; 181/50; 181/51; 181/71

[51] Int. Cl.[2] ..... B05B 7/08; F01N 1/10; F01N 1/14

[58] Field of Search ..... 181/33 HC, 42, 50, 36 A, 181/43, 51, 64 B, 33 HD, 65, 71; 239/DIG. 7, DIG. 21, DIG. 22, 291, 314, 418, 422, 423, 424, 424.5, 587, 265.13, 588

[56] References Cited

UNITED STATES PATENTS

| | | | |
|---|---|---|---|
| 2,293,181 | 8/1942 | Terman | 181/71 X |
| 2,334,263 | 11/1943 | Hartwell | 181/42 X |
| 2,797,964 | 7/1957 | Alexander | 239/422 X |
| 3,117,726 | 1/1964 | Schoberg | 239/291 |
| 3,318,534 | 5/1967 | Stoltcben | 239/291 |
| 3,589,383 | 6/1971 | Garnier | 239/DIG. 7 |
| 3,628,737 | 12/1971 | Norton | 239/DIG. 7 |
| 3,735,778 | 5/1973 | Garnier | 239/DIG. 7 |
| 3,794,137 | 2/1974 | Teodorescu et al. | 239/DIG. 7 |
| 3,795,288 | 3/1974 | Pall | 181/71 X |
| 3,859,205 | 1/1975 | Reba et al. | 239/DIG. 7 |

FOREIGN PATENTS OR APPLICATIONS

| | | | |
|---|---|---|---|
| 1,408,538 | 7/1965 | France | 239/291 |

*Primary Examiner*—Robert S. Ward, Jr.
*Attorney, Agent, or Firm*—Milton E. Gilbert

[57] ABSTRACT

An air nozzle is provided which produces high thrust with low noise. The nozzle is adapted to provide flow amplification by inducing flow of ambient air with high pressure air.

23 Claims, 4 Drawing Figures

NOZZLE

RELATED APPLICATIONS

This application is a continuation-in-part application of my U.S. Application Ser. No. 500,647 filed Aug. 26, 1974, now abandoned.

This invention relates to fluid delivery nozzles and more particularly to nozzles which exhibit high thrust and low noise.

Various types of fluid delivery nozzles have been proposed for use in manufacturing establishments where a stream of air is directed to perform a function such as ejecting parts of blowing refuse from a machine or work station. In such applications, it is desirable that the stream be concentrated and that the working force of the stream be substantial. In this respect the prior art is exemplified by U.S. Pat. Nos. 3,129,892, 3,599,876, 3,814,329, 3,647,142, 3,263,934, 3,743,186, 3,801,020, 3,806,039 and 3,795,367, and the references cited in the files of said patents. However, many well known types of nozzles have been finding increasing objection in view of recently enacted health and safety regulations. A particular objection to many existing nozzles is that they produce uncomfortable, and in some cases unbearable, noise levels. This is due to the fact that in most factories or shops where pneumatically operated equipment is employed, the compressed air lines will have an air pressure ranging from about 90–125 psi. Accordingly, the high pressure jets tend to produce unreasonably high noise levels. While some air nozzles have been devised which exhibit reduced noise levels, they do not reduce the noise levels to an acceptable level or else achieve reduced noise levels at the expense of reduced thrust or other limitations.

Accordingly, a primary object of this invention is to provide a nozzle which exhibits high thrust and low noise levels.

A further object of this invention is to provide a nozzle of the character described wherein ambient air is induced into an air stream by use of high pressure air so as to provide a stream having an effective working force or thrust.

Still another object is to provide a nozzle which is extremely simple in construction, reliable and durable in use and economical to manufacture.

The foregoing objects and other objects hereinafter disclosed or rendered obvious are achieved by providing a nozzle which comprises an inlet for connection to a source of high pressure air, an air passageway for conducting an air stream from the inlet to a nozzle discharge opening, at least one group of one or more ports intermediate the inlet and the discharge opening for conducting pressurized air out laterally from the passageway, and means including an appropriately shaped outer nozzle surface for causing the compressed air exiting the one or more ports to induce a flow of amibent air along the outer surface of the nozzle toward the nozzle's exit end so as to provide a working stream which combines the pressurized air discharged from the main passageway and the induced ambient air. Since the mass of the resulting working stream is greater than that of just the pressurized air stream which exits the passageway, it accordingly enhances the working force of the combined stream substantially over that of only the discrete pressurized air stream which exits the passageway. A selected air-permeable flow-modifying element is disposed in the passageway for the purpose of causing the stream flowing in the passageway to assume a laminar flow characteristic, whereby to reduce noise while at the same time permitting the air stream in the passageway to exit the nozzle at a high velocity. The flow-modifying element also provides a back pressure which forces air to exit the passageway via the one or more ports whereby to induce ambient air to flow along the outer nozzle surface toward the nozzles exit.

Other features and many of the attendant advantages of this invention are disclosed by the following detailed description which is to be considered together with the accompanying drawings, wherein.

The same numerals are used in the several figures to designate identical parts.

Figure 1:
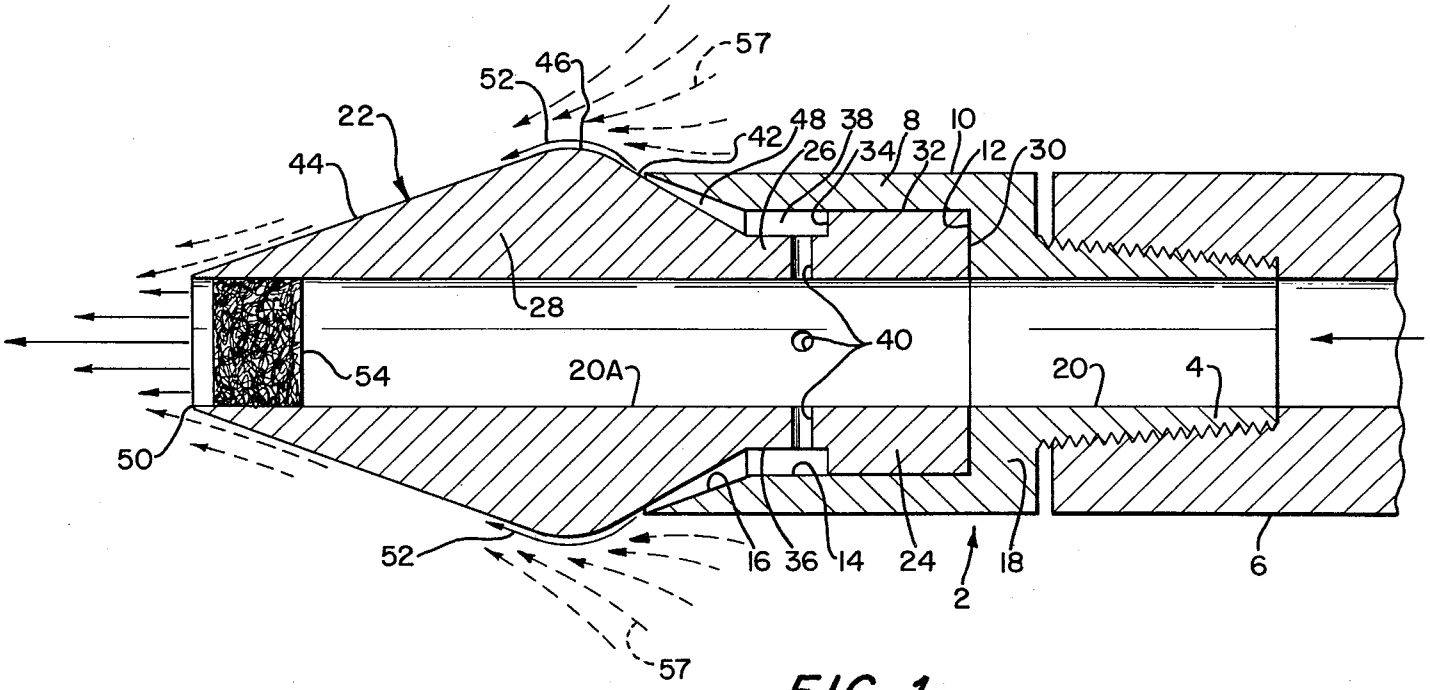
FIG. 1 is a longitudinal section of a preferred embodiment of the invention.

The present invention makes use of a modification of the Coanda or wall attachment principle to entrain ambient air in a high velocity small mass air stream. As disclosed by Coanda U.S. Pat. Nos. 2,052,869 and 3,047,208, and as exemplified in nozzle applications by U.S. Pat. Nos. 3,743,186, 3,801,020, 3,806,093 and 3,795,367, the Coanda effect basically involves discharging a small volume of a primary fluid under a high velocity from a nozzle having a shaped surface adjacent the nozzle, whereby the stream of primary fluid tends to follow the shaped surface and as it does, it induces a surrounding secondary fluid — notably, ambient air — to flow with it along the shaped surface. The result is that an exhaust stream is produced which combines both fluids. Thus nozzles constructed in accordance with the principles established by Coanda exhibit high thrust due to the amplification in flow produced by the Coanda effect. However, existing Coanda effect nozzles do not have a satisfactory noise limiting capability or else are expensive to manufacture. Hence, for reasons of comfort with respect to noise as well as cost, other type of nozzles tend to be preferred in many installations even though they exhibit less thrust or achieve comparable thrust at the expense of greater consumption of pressurized air.

It has been recognized that in nozzles, high thrust tends to give high noise levels and low noise levels can be achieved only at the expense of reduced thrust. The problem of achieving both high thrust and low noise levels may be explained by considering the mathematical statements governing thrust and acoustical power for a nozzle. The pertinent statements for thrust and acoustical power are respectively as follows:

$$T = \frac{W}{g} u \qquad (1)$$

and $$W_{AC} \propto \left(\frac{u}{c}\right)^7 \qquad (2)$$

where $T$ = thrust in pounds;

$W$ = weight flow rate (lb/sec);
$g$ = acceleration due to gravity (ft/sec$^2$);
$u$ = air stream velocity (ft/sec);
$W_{AC}$ = acoustical power (watts); and
$c$ = local velocity of sound in medium (ft/sec).

The acoustical power (noise emitted) of a nozzle increases by a factor of air stream velocity to the seventh power whereas thrust increases by a factor of velocity to the first power. Therefore, from the foregoing mathematical statements, it is apparent that a possible way to increase thrust without substantially increasing noise is to increase the weight flow rate without increasing the air stream velocity. However, such a solution cannot be adapted in practice to a straight nozzle because of size limitations. This can be seen from the following equations:

$$W = Qd \quad (3)$$
$$Q = uA \quad (4)$$

where $W$ = weight air flow (lb/sec);
$Q$ = air flow rate (ft$^3$/sec);
$d$ = local air density (lb/ft$^3$);
$u$ = air stream velocity (ft/sec); and
$A$ = cross-sectional area of nozzle orifice (ft$^2$)

Since the local air density is substantially constant, increasing the weight flow rate by increasing the air flow rate, while maintaining a relatively small flow velocity, can be achieved only by increasing the cross-sectional area of the nozzle orifice, but this has severe practical limitations in nozzles for industrial blow-off or ejection applications. Therefore, the only practical solution is to use a form of air amplifier whereby ambient air is drawn into the main air stream while keeping the flow through the orifice of the nozzle at a minimum.

The present invention provides a nozzle that is similar to the Coanda-type nozzles disclosed by U.S. Pat. Nos. 3,743,186, 3,795,367, 3,801,020 and 3,806,039 in that it involves air amplification, but it differs therefrom in that the air amplification is achieved by combining the pressurized air and the ambient air outside of and downstream of the exit orifice of the nozzle. It also differs in that flow-modifying means are provided for reducing the noise of the pressurized air stream flowing through the nozzle and producing a laminar jet at the exit orifice, whereby induced ambient air flowing around the outside of the nozzzle can blend with the main jet stream without creation of noise producing eddies and vortices.

Turning now to FIG. 1, the illustrated nozzle comprises a bushing or housing 2 which has a reduced diameter threaded extension 4 for connection to a conduit 6 which leads to a source (not shown) of a pneumatic medium such as compressed air. The main portion of the bushing is in the form of a cylindrical shell 8 which has a cylindrical outside surface 10. The inside of shell 8 comprises an annular end surface 12, a cylindrical surface 14 that extends forwardly of end surface 12, and a frustoconical surface 16 which forms an outwardly tapered or flared opening for the shell. The end section 18 of the shell and the threaded extension have a common centrally located and smooth surfaced bore 20 that has a circular cross-section and serves as an inlet and a flow passageway for the pressurized pneumatic medium.

Attached to the bushing 2 is a nozzle element identified generally as 22. The latter has a centrally located smooth-surfaced bore 20A that is the same size as and is aligned with bore 20. Nozzle element 22 comprises an end section 24, a throat section 26, and a main section 28. End section 24 has a flat annular rear surface 30, a cylindrical outer surface 32, and a flat annular front end surface 34. Surface 32 is sized to make a tight friction fit with the inner surface 14 of the shell. Throat section 26 has a cylindrical outer surface 36 that has a smaller diameter than surface 32 whereby to provide an annular chamber 38 between it and the shell. Additionally, the throat section has at least one and preferably several ports 40 that lead from bore 20A to chamber 38. Preferably, but not necessarily, the axes of ports 40 extend at a right angle to bore 20A.

The exterior of main section 28 has a generally bulbous shape characterized by a rear frusto-conical surface 42, a front oppositely tapered frusto-conical surface 44, and a convex circumferentially-extending transition surface 46. The nozzle section is sized so that its rear outside surface 42 is spaced from the adjacent surface 16 of the shell. Preferably the shape of the rear frusto-conical surface 42 is linear and is set so that, with increasing distance from throat section 26, it converges toward the adjacent surface 16 of the shell, whereby to form an annular passageway or orifice 48 that communicates with chamber 38 and whose cross-sectional area decreases progressively with increasing distance from chamber 38. Preferably, but not necessarily, the axial length of the outer surface of the annular throat section is set so that its junction with surface 42 is aligned radially with the junction of surfaces 14 and 16 of the shell, as shown. The frusto-conical surface 42 preferably is long enough so that its forward end projects radially beyond the outer surface of the shell, whereby the transition surface 46 is in position to intercept ambient air flowing along the outer surface of the bushing toward the nozzle element. The convex transition surface 46 preferably has a smooth circular curvature in longitudinal section, but the convex curvature could be formed according to a parabolic or other suitable function. The frusto-conical surface 44 is formed so that its front end terminates close to the axial bore 20A. Preferably, its front end intersects or nearly intersects the axial bore so that the nozzle element has a relatively narrow front edge as shown at 50. While a relatively thin knife edge may be advantageous for optimum merging of ambient air with the air stream exiting from bore 20A, it is preferred that edge 50 be somewhat blunt so as to minimize possible injury to workmen. In any event, the slope and length of surface 44 are set so that the inducted ambient air and the pressurized air stream from bore 20A will merge in a smooth transition without the creation of noise producing eddies and vorteces.

It also is essential that the slopes of confronting surfaces 16 and 42 and the minimum gap therebetween be set so that air will exit the orifice 48 as a thin film which will tend to adhere to and flow along surface 42 over surface 46 and along surface 44 in the manner shown by the arrows 52. By way of example, in a preferred embodiment of the invention, the surface 44 has a slope of about 20° with respect to the common axis of bores 20 and 20A, surfaces 16 and 42 have slopes with respect to the same axis of 20° and 30° respectively, and the gap between surfaces 16 and 42 is between about 0.003 and 0.006 inch.

It is also essential, for better promotion of laminar flow and to reduce noise, that the bore 20A have a diameter substantially the same as or smaller than bore 20. Preferably bores 20 and 20A are the same size and the end surfaces 12 and 30 engage one another as shown, since this arrangement provides a smooth transition from bore 20 to bore 20A and thus avoids creation of eddies and turbulence in the air stream as it passes into bore 20A. Making bore 20A larger than bore 20 allows the pressurized pneumatic medium to expand as it passes into bore 20A, and such expansion promotes turbulence and creates noise.

Also forming part of the nozzle assembly is a flow-modifying noise-reducing element 54 which is essentially a cylindrically shaped plug and preferably, but not necessarily, is formed with flat end surfaces as shown. Noise-reducing element 54 is made of a knitted wire mesh fabric and may be formed in situ or preformed and installed after formation.

Figure 2:
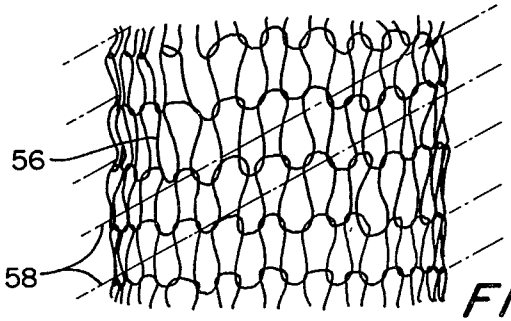
FIG. 2 is a diagrammatic view on an enlarged scale of a piece of knitted metal wire mesh.

The element 54 is made generally in accordance with the teachings of U.S. Pat. No. 2,334,263 issued Nov. 16, 1943 to R. L. Hartwell for Foraminous Body and Method of Producing Same. Element 54 consists of a compressed mass of metal wire charactrized by a closely packed, interlocked wire structure that forms a coherent body. The element is fabricated from knitted metal wire mesh of selected gauge. The mesh may be knit flat or tubular and may be of selected mesh loop size. Preferably it is knitted as a tube or sock on a circular knitting machine. In its simplest form, the knitted wire mesh tube may be knitted from a single continuous length of metal wire which is so manipulated as to form a continuous tube in which successive turns of the wire form lengths which extend circumferentially of the tube and are interlocked by stitches. Each length is bent locally beyond its elastic limit as a result of the formation and interlocking of loops or stitches as the tube is knitted. Thus each circumferential length, in effect, forms a flattened spring which may be stretched or compressed. The finished tube or sock is flattened longitudinally so as to form a two-ply ribbon. Preferably, but not necessarily, the flattened tube may be corrugated traversely to provide further interlocking between the lengths of wire in the plies thereof. Corrugating the fabric is known in the art as "crimping" and the product is commonly called "crimped knitted wire-mesh fabric". The tube may be corrugated at a right angle to its axial length or at a different angle, e.g., 45°, in the manner disclosed by the Hartwell patent. FIG. 2 presents a side view of a portion of a knitted wire mesh fabric tube as above described. The fabric is seen to comprise circumferential turns of wire 56 with each turn having loops or stitches which are interlocked with adjacent turns. In this case, the fabric is crimped along spaced diagonal lines 58.

Knitted wire mesh fabric and the method of making the same are well known (in this connection see also U.S. Pat. Nos. 3,346,302, 2,680,284, 2,869,858 and 2,426,316).

In the practice of this invention, the knitted wire mesh fabric is preferably made of a stainless steel wire, although other steels and alloys may be used.

Preferably the flow-modifying element 54 is made by flattening a knitted wire mesh fabric tube upon itself to form a flat two-ply ribbon, and then rolling the ribbon upon itself. The ribbon is wound up in the manner shown in FIG. 2 of U.S. Pat. No. 3,346,302 (except that it is not wound upon a mandrel) and FIG. 2 of the Hartwell patent, with the result that the rolled up body is generally cylindrical to the width or transverse dimension of the ribbon extends parallel to the body's longitudinal axis. More specifically, the cylindrical body consists in cross-section of a continuous spiral convolute. In this generally cylindrical body the lengths of wire making up each turn of the fabric tube are now largely so oriented as to extend from one end of the body to the other in directions generally parallel with the body's longitudinal axis. This cylindrical body is then compressed and molded into a flow-modifying noise-reducing element of desired density and shape.

Figure 3:
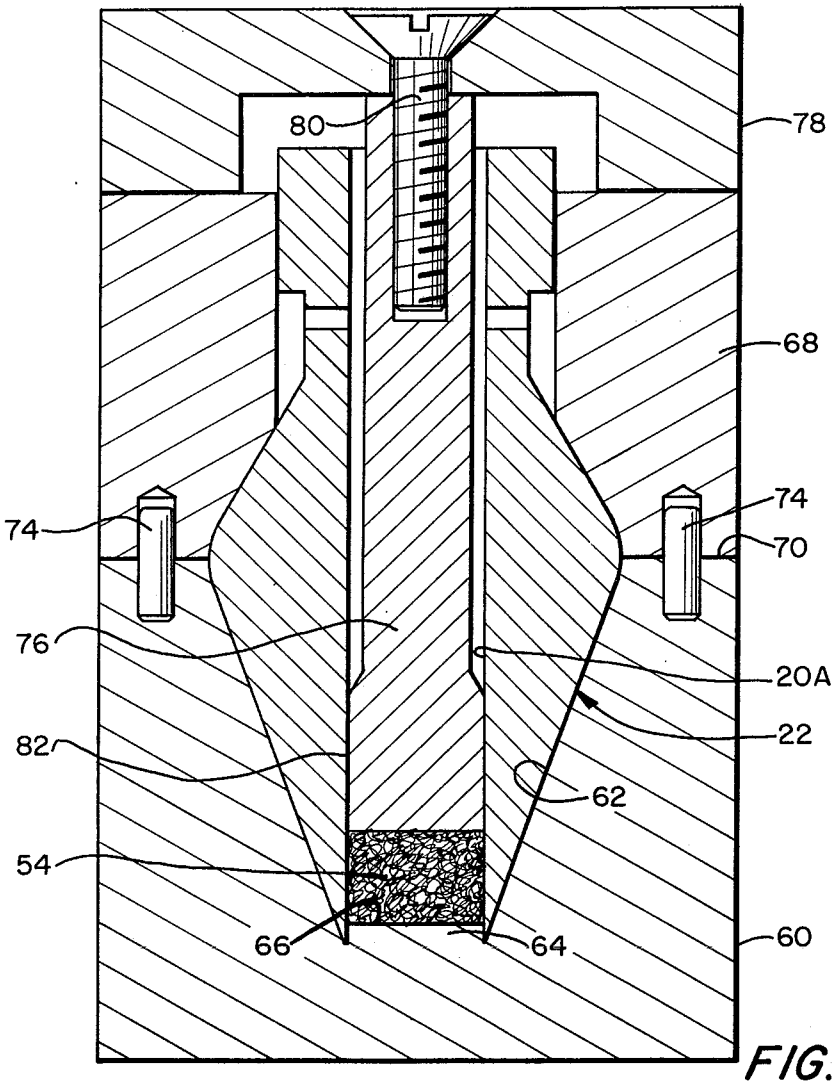
FIG. 3 is a sectional view of a die for forming the flow-modifying element.

FIG. 3 shows a forming die assembly made of tool steel for forming the element 54 in situ. The forming die assembly comprises a stationary die 60 having a cavity 62 shaped to receive the forward portion of the main section 28 of the nozzle element and a cylindrical extension 64 at the base of the cavity which is sized to fit snugly within the bore 20A. The upper surface of extension 64 has a flat end surface 66. A die sleeve 68 fits down over the rear portion of main section 28 and seats on the flat upper surface 70 of die 60. Sleeve 68 makes a close fit with the surfaces 42 and 32 of the nozzle element and is held against lateral movement by dowels 74 which are embedded in the upper surface 70 of the die and make a sliding fit in holes in the sleeve. The die assembly also comprises a piston unit consisting of an elongate piston 76 and a piston head 78 secured to the piston by a screw 80. The bottom end of piston 76 is enlarged and has a cylindrical outer surface 82 sized to make a close sliding fit with bore 20A.

In molding the element 54 in situ, the die assembly is mounted in a press (not shown) having a stationary bed and a vertically reciprocal pressure head, with the die member 60 being fixed to the bed and the piston assembly being mounted to the pressure head in vertical alignment with the die member. With the die assembly open, the nozzle element is inserted in the cavity of die 60 and sleeve 68 is positioned as shown so as to hold the nozzle element centered. Then the rolled-up or folded knitted wire mesh fabric is inserted into the upper end of the nozzle element and the piston unit is operated to drive the fabric body into the housing. The length of knitted wire mesh fabric tube employed in forming the element 54 is set so that when the element is formed it has a density which is a predetermined percentage of the density of the metal of which the wire mesh fabric is made. The cylindrical wire mesh body formed by rolling up the flattened wire mesh fabric tube is inserted in the bore 20A so that the rolled up layers of the wire mesh fabric tube extend axially of and are compressed radially by the surrounding surface of the nozzle element, i.e., the cylindrical knitted mesh body is inserted so that its axis of convolution extends parallel to the axis of bore 20A. The fabric body is compressed and molded by the compressive co-action of die extension 64 and the end of the piston 76. The extent of penetration of the piston unit determines the final size and density of the mass 54 of knitted wire mesh fabric, and preferably the desired density is achieved when the piston unit bottoms on the upper end of die sleeve 68. The formed element 54 and housing nozzle element 22 are tightly gripped together by a friction fit and the element is self-supporting and has excellent structural integrity.

The nozzle element in the embodiment just described is preferably made of material that is softer than the material of which the element 54 is made. Preferably, nozzle element 22 is made of aluminum or an aluminum alloy while element 54 is made of stainless steel knitted wire mesh. As a consequence, as the element 54 is formed in situ, portions of the wire of which it is made will abrade and in some places actually cut into the interior surface of the nozzle element, with the result that the element is mechanically interlocked with the housing. Additionally, the formed element has a certain amount of spring action and as a consequence, it exerts a radial force against the surrounding nozzle element which further improves the mechanical gripping action between the two parts. A connection of almost equal strength can be achieved between the nozzle and element 54 where the latter is preformed since the preformed element also has a certain spring action. Accordingly, by making the preformed element slightly oversized, it is possible to assure a strong press-fit connection to the nozzle element. Again due to the difference in materials hardness, as the preformed element is forced into bore 20A, portions of the wire of which it is formed will abrade and cut into the interior surface of nozzle element 22 so that it is mechanically interlocked with the nozzle element.

The bushing 2 may be made of the same material as the nozzle element or a different material. Thus, for example, if nozzle element 22 is made of aluminum, bushing 2 may be made of aluminum or stainless steel. The bushing may be, and preferably is, secured to the nozzle element by a press-fit as previously described, or it may be secured by other means known to persons skilled in the art.

As the rolled up or convoluted body of knitted wire mesh fabric is compacted and molded into the element 54, it is tightly compressed in directions transverse to the width of the flattened tube or ribbon, i.e., it is compressed both radially and axially, with the result that the turns or length of wire are crimped at innumerable points beyond their elastic limits so that they take a more or less permanent set. Additionally, as the wire mesh fabric is compressed, the wire is so deformed as to produce a compressed mass or body consisting of a very great number of uniformly distributed, randomly directed, relatively short spans or lengths of wire which contact each other at innumerable points within the mass, with the result that these spans or lengths are intimately interlocked substantially uniformly throughout the entire volume of the mass with portions of the spans of wire being spaced to form small pockets and passageways of capillary size. The net result is a relatively dense yet porous cohesive or self-supporting body consisting of fine, intermingled and interconnected spring wire spans and characterized by substantial structural integrity, controlled density, a uniform and fine porosity, and a controlled spring constant. The multiplicity of short spans of wire, the uniformity of distribution and random directions of such spans, and the innumerable points of contact between them, all contribute to the capability of the element to modify the flow of air through bore 20A so that it will exit the nozzle as a laminar flow jet stream.

Operation of the device of FIG. 1 as an air nozzle will now be described. Compressed air enters the nozzle through the conduit 6, flows along bores 20 and 20A and through the element 54, and escapes via the exit orifice defined by annular end surface 50 of the nozzle element. Since the wire mesh plug 54 offers some resistance to free flow of the compressed air, a back pressure is created upstream of the element. Consequently, part of the pressurized air supplied to bore 20 is diverted out of the bore through ports 40 into chamber 38 and then flows out of chamber 38 via the small gap annular orifice formed between surfaces 16 and 42. In passing out of this small gap orifice, the pressurized air forms a very thin film moving at a high velocity. Since air moving at a high velocity has a static pressure less than atmospheric pressure, a partial vacuum is created which on one side makes the air film cling to and follow the exterior contour of the nozzle element as shown by the arrows 52, and on the other side draws in ambient air as shown by arrows 57. The thin air film and the induced ambient air flow along surface 44 and merge with the air stream discharged from bore 20A, thus in effect amplifying the air flow directed by the nozzle. It is to be noted that the transition surface 46 is located wholly to one side of the line of discharge of air from the narrow gap orifice 48 formed between surfaces 16 and 42, and this transition surface (and whatever portion of surface 42 projects beyond the outer end of surface 16) acts to guide the air flowing out of orifice 48. A differential pressure effect is created which causes the air film to attach itself to the exterior surface of the nozzle element and induces the ambient air to follow the path of the thin film. As indicated earlier, the element 54 modifies the flow of air in bore 20A so that the main compressed air stream forms a laminar jet on passing through that element and out of the nozzle. Element 54 thus reduces the noise produced by the compressed air flowing out of the nozzle via bore 20A and a further noise reduction occurs because the laminar jet allows the induced air flowing around the nozzle to combine with it in a smooth transition without any noise-producing eddies and vortices.

The following example illustrates the extent of noise reduction and the magnitude of the thrust achieved by the present invention. A nozzle was made having a construction as shown in FIG. 1. The bores 20 and 20A had a diameter of 0.312 inch, and two diametrically opposed ports 40 were provided having a diameter of 0.09 inch. The gap at the exit end of orifice 48 measured about 0.003 inch and the surfaces 42 and 44 extended at angles of 30° and 20° to the axis of bore 20A. The curvature of surface 46 in longitudinal section was substantially that of a circular arc and its apex was about 0.45 inches from the axis of bore 20A. The nozzle element 22 and bushing 2 were made of aluminum and the element 54 was made of two-ply stainless steel knitted wire mesh ribbon. Element 54 was formed in-situ in the manner above described and in its as-formed condition had a density of 40% of the density of the stainless steel wire making up the knitted wire mesh fabric. Element 54 had an axial length of about 0.25 inch. The bushing 2 was connected to a 100 psi pressurized air supply and the noise and thrust of the nozzle were determined according to well known techniques. The noise level was measured at a point about 36 inches downstream of the nozzle. The noise level was found to be 81dBA and the thrust was found to be 1.0 lbf, and the flow through the nozzle was 29 scfm. By way of comparison, the noise produced by air discharged at the rate of 29 scfm from an ordinary pipe having the same internal diameter as bore 20A was found to be about 99dBA and the thrust was about 0.95lbf.

It is to be appreciated that for certain applications it may not be necessary to effect any noise reduction or to provide the degree of noise reduction achieved with preferred embodiments of the invention. Thus, the invention may be practiced without the use of noise-reducing element 54 constructed as above described.

Figure 4:
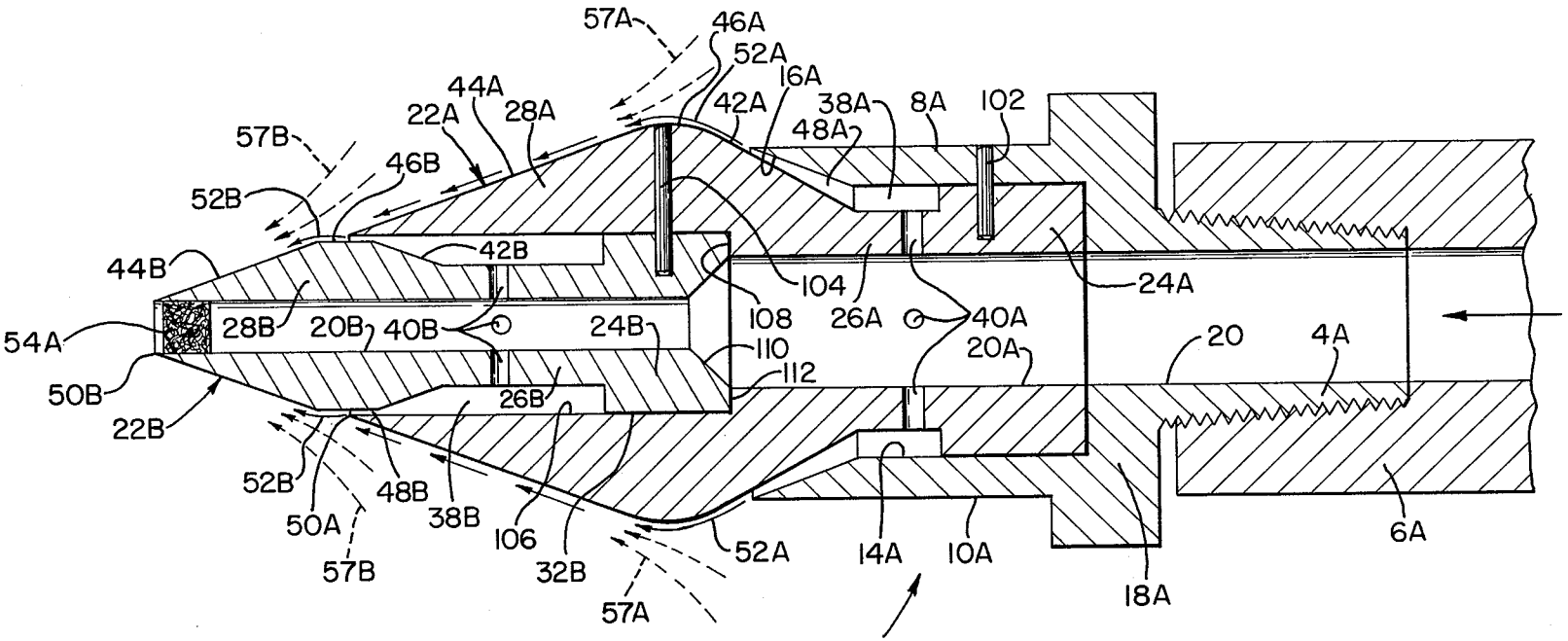
FIG. 4 is a longitudinal section of a second embodiment of the invention.

An air nozzle having a construction as shown and described in FIG. 1 thus exhibits relatively high thrust and low noise levels. In order to provide even greater thrust while maintaining substantially low noise levels, the air nozzle of the present invention may be modified to include a second amplifying stage. Referring to FIG. 4, an air nozzle similar to the nozzle shown in FIG. 1 and modified to include such a second stage is illustrated. The two-stage nozzle comprises a housing 2A which has a reduced diameter threaded portion 4A for connection to the pressurized air conduit 6A. The housing 2A includes a cylindrical shell 8A which is similar to the shell shown and described in the FIG. 1 embodiment. The shell 8A, however, has been modified to include one radially-extending hole which is located forwardly of end section 18A and extends through the surfaces 10A and 14A for accommodating a roll pin 102.

A nozzle element 22A similar to the nozzle 22 of FIG. 1, is attached to the housing 2A. The nozzle element 22A, thus includes an end section 24A, throat section 26A, and a main section 28A. End section 24A has been modified to include at least one radially directed hole for accommodating the roll pin 102 so that the nozzle element is restrained from axial movement with respect to shell 8A. The throat section 26A includes at least one, and preferably a plurality of ports 40A which communicate with the annular chamber 38A which in turn communicates with passageway 48A. The latter is defined by the space between the surface 16A of shell 8A and the main section 28A.

Main section 28A, which is provided with the front and rear frusto-conical surfaces, 42A and 44A, respectively, and the transition surface 46A, is modified to include at least one radially-directed hole which extends from transition surface 46A entirely through main section 28A for accommodating a roll pin 104. The front interior end of the nozzle element 22A is provided with a counter bore 106 which forms a radially-directed annular shoulder 108 with the bore 20A of the nozzle element.

In order to provide even greater thrust while maintaining low noise levels, a second nozzle element, identified generally at 22B, is attached to the element 22A. The second nozzle element 22B is disposed in counterbore 106 and has a centrally-located smooth-surfaced bore 20B which is aligned with bore 20A and countersunk at the rear as shown at 110. The front end of bore 20B is provided with a flow-modifying noise reducing element 54A, the latter being made, formed and installed in the same manner as element 54 previously described.

The nozzle element 22B also includes an end section 24B, a throat section 26B and a main section 28B. The end section 24B has a flat annular rear surface 112 which contacts the shoulder 108, and a cylindrical outer surface 32B which is sized to make a tight friction fit with the inner surface of counterbore 106. The end section 24B is modified to include a radially-directed hole for accommodating the roll pin 104 so that the second nozzle element 22B is restrained from axial movement with respect to the first nozzle element 22A.

The throat section 26B includes at least one, and preferably a plurality of ports 40B which communicate with the annular chamber 38B provided between the throat section 26B and the surface of counter bore 106. The annular chamber 38B in turn communicates with an annular orifice or passageway 48B which is defined by the space between the surface of counter bore 106 and the main section 28B.

The exterior of the main section 28B generally has a shape which is similar to the bulbous shape of main section 28A, in that it includes front and rear frusto-conical surfaces, 44B and 42B, respectively, which are of the same slope as the respective surfaces 42A and 44B. The section 28B has been modified however so that the transition surface 46B is a cylindrical, circumferentially-extending surface. The second nozzle element 22B is sized so that the front frusto-conical surface 44B is substantially coincident with front surface 44A and intersects the counter bore 106 at annular end surface 50A.

The slope and length of front surface 44B are set so that the ambient air and the pressurized air stream exiting bore 20B will merge in a smooth transition without the creation of noise producing eddies and vortices.

It is also essential that the gap between the surface of the counterbore 106 and the cylindrical surface 46B of the nozzle element be set so that air will exit the orifice 48B as a thin film which will tend to join with the flow of ambient air along surface 44A of the first nozzle element and surface 44B of the second nozzle element. By way of example, in a preferred embodiment of the two stage amplification device the surfaces 44A have a slope of about 20° with respect to the common axis of bores 20A and 20B, surface 42B has a slope with respect to the same axis of about 33°, and the gap between the cylindrical surface of counterbore 106 and cylindrical surface 46B of the second nozzle element between about 0.003 and 0.006 inch.

In order to promote laminar flow and reduce noise, the largest diameter of the countersink 110 of the second nozzle is substantially the same as or smaller than bore 20A, while the diameter of the bore 20B is smaller than bore 20A. Preferably, the largest diameter of the countersunk portion 110 and the diameter of bore 20A are the same size and the end surfaces 108 and 112 engage one another as shown, since this arrangement provides a smooth transition from bore 20A to bore 20B and thus substantially avoids creation of eddies and turbulence in the air stream as it passes into bore 20B.

Operation of the two stage amplification device of FIG. 4 as an air nozzle will now be described. Compressed air enters the nozzle through the conduit 6A, flows along bores 20, 20A and 20B and through element 54A, and escapes via the exit orifice defined by annular end surface 50B of the second nozzle element. As previously described, since the wire mesh plug 54A offers some resistance to free flow of the compressed air, a back pressure is created upstream of the element. Consequently, part of the pressurized air supplied to bore 20A is diverted through ports 40A into chamber 38A and then flows out of chamber 38A via the small gap annular orifice 48A between surfaces 16A and 42A. In passing out of this small gap orifice 48A, the pressurized air forms a very thin film moving at a high velocity, which clings to and follows the exterior contour of the nozzle elements 22A as shown by the arrows 52A and draws in ambient air as shown by arrow 57A, as previously described in reference to FIG. 1.

Simultaneously, the back pressure created upstream by the presence of element 54A causes part of the pressurized air supplied to bore 20B to be diverted out of the bore through ports 40B into chamber 38B formed between the cylindrical surface 46B of the second nozzle element 22B and the surface of counterbore 106. In passing out of orifice 48B, the pressurized air forms another very thin film moving at high velocity. Since the static pressure of this thin film of air is less than atmospheric pressure, a partial vacuum is created which on one side makes the air film cling to and follow the exterior contour of the second nozzle element 22B as shown by arrows 52B and on the other side draws ambient air as shown by arrows 57B. The thin air film provided by orifice 48B and the induced ambient air as shown by arrows 57B is guided over transition surface 44B together with the air stream from the first stage represented by arrows 52A and 57A. Thus, the additional annular orifice which is introduced by the second amplification stage increases the thrust of the nozzle while maintaining low noise levels.

It is to be appreciated that for certain applications it may not be necessary to effect any noise reduction or to provide the degree of noise reduction achieved with preferred embodiments of the invention. Thus, the invention may be practiced without the use of noise-reducing elements 54 or 54A constructed as above described. If noise is of no consequence, elements 54 and 54A are entirely omitted, and in the FIG. 1 embodiment bore 20A must be modified to create the needed back pressure. This can be achieved in various ways, e.g., by forming bore 20A with a reduced diameter section downstream of ports 40 or providing it with a baffle or other obstruction member for impeding air flow and thus creating a suitable back pressure. In the FIG. 4 embodiment the needed back pressure may be provided by the fact that bore 20B is of a smaller diameter cross section with respect to bore 20A.

Obviously the nozzle may be made other than as herein shown and described. Thus, for example, the shape and dimensions of the nozzle element and the bushing may be varied and the latter may be adapted to be secured to a conduit by other than a screw connection. In the device of FIG. 1, a roll pin similar to pin 102 also may be used to secure nozzle 22 to shell 8. Also, more than one noise-reducing element may be installed in bore 20A (FIG. 1) or 20B (FIG. 4) as disclosed by co-pending U.S. Pat. Application Serial No. 388,636, filed Aug. 15, 1973 by Alain Frochaux and Charles M. Salerno for Noise-Reducing Fluid-Flow Devices. Furthermore, while the illustrated nozzle is intended for use with air, it also may be used as a nozzle for other fluids.

What is claimed is:

1. A high-thrust low-noise nozzle adapted to effect movement of a secondary fluid by a pressurized primary fluid comprising, tubular means forming a passageway having an entrance and an exit orifice, said entrance being adapted for connection to a source of pressurized primary fluid, at least one port communicating with the passageway between said entrance and exit orifice, means cooperating with said port for directing flow of primary fluid from said port in a direction so as to induce flow of a secondary fluid along the outside of said tubular means toward said exit, and noise-reducing means positioned in said passageway between said exit orifice and said port, said noise-reducing means creating sufficient back pressure to force some of the pressurized pirmary fluid to flow out of said passageway via said port.

2. A nozzle according to claim 1 wherein said noise-reducing means comprises an element that is made up of a knitted metal wire mesh fabric that has been convoluted and compressed and molded into a self-supporting, dense, porous mass with the wire threads of said fabric oriented randomly in said mass.

3. A high-thrust, low-noise nozzle comprising a body having means defining a passageway, an entrance for admitting a pressurized primary fluid to said passageway, and an exit at one end of said body for discharging a stream of said primary fluid from said passageway, said body also having an exterior surface that is disposed so as to converge toward said passageway at said one end, and flow inducing means including at least one port communicating with said passageway between said exit and said entrance for conducting some of the pressurized primary fluid out of said passageway via said port and directing it along said surface toward said one end so as to induce a secondary fluid surrounding said body to flow along said surface and merge with the stream of primary fluid discharged from said exit.

4. A nozzle according to claim 3 wherein said exterior surface surrounds said passageway and is tapered toward said one end.

5. A nozzle according to claim 3 wherein said flow inducing means comprises a second exterior surface on said body which is disposed so as to converge toward said passageway away from said exit end, and a transition surface that extends between said first and second mentioned exterior surfaces.

6. A nozzle according to claim 5 wherein said flow inducing means includes means spaced from said second exterior surface for directing primary fluid to flow from said port along said second exterior surface, so that substantially static secondary fluid surrounding said second exterior surface is induced to flow with primary fluid in turn over said transition surface and said first mentioned surface.

7. A nozzle according to claim 6 wherein said spaced means comprises an annulus surrounding and spaced from said body.

8. A nozzle according to claim 7 wherein said annulus surrounds the portion of said body that includes said port.

9. A nozzle according to claim 3 including a fluid-permeable element in said passageway between said exit and said port.

10. A nozzle according to claim 9 wherein said fluid permeable element comprises a compressed mass of a wire mesh fabric.

11. A nozzle according to claim 9 wherein said fluid permeable element is made so as to effect substantially laminar flow of the stream of pressurized primary fluid discharged from said exit.

12. An amplifier nozzle adapted to effect movement of a secondary fluid by a pressurized primary fluid so as to produce a stream made up of said primary and secondary fluids, said nozzle comprising an elongate body having a first tapered section at one end thereof, a second oppositely tapered section, a transition section contiguous with and joining said first and second tapered sections, an end section at one end, and a throat section contiguous with and joining said second tapered section to said end section, a longitudinally extending bore in said body forming a passageway extending through said sections, an inlet at said opposite end of said body for admitting a pressurized primary fluid to said passageway and an exit at said one end for discharging a stream of said primary fluid from said passageway, a shell attached to said end section, said shell surrounding but spaced from said throat section and at least part of said second tapered section, a chamber between said shell and said throat section, at least one port in said throat section for conducting primary fluid from said passageway into said chamber, and a narrow orifice formed between said shell and said second tapered section for conducting primary fluid in a thin stream out of said chamber and along said second tapered and transition sections so as to induce a static secondary fluid surrounding said shell to flow with said thin stream of primary fluid along said first tapered section toward said one end of said body and combine with the stream of primary fluid discharged at said exit.

13. A high-thrust low-noise nozzle adapted to effect movement of a secondary fluid by a pressurized primary fluid comprising, tubular means forming a passageway having an entrance and an exit orifice, said entrance being adapted for connection to a source of pressurized primary fluid, at least one port communicating with the passageway between said entrance and exit orifices, at least one other port communicating with said passageway between the first mentioned port and said exit orifice, means cooperating with said first mentioned and one other ports for directing flow of primary fluid from each of said ports in a direction so as to induce flow of a secondary fluid along the outside of said tubular means toward said exit, and noise-reducing means positioned in said passageway between said exit orifice and said one other port for effecting substantially laminar flow of the stream of pressurized primary fluid discharged from said exit orifice, said noise-reducing means creating sufficient back pressure to force some of the pressurized primary fluid to flow out of said passageway via said first mentioned and one other ports.

14. A high-thrust, low-noise nozzle comprising a body having means defining a passageway, an entrance for admitting a pressurized primary fluid to said passageway, and an exit at one end of said body for discharging a stream of said primary fluid from said passageway, said body also having first and second exterior surfaces that are disposed so as to converge toward said passageway at said one end, and flow inducing means including at least two ports, one of said ports communicating with said passageway between said exit and said entrance for conducting some of the pressurized primary fluid out of said passageway via said one port and directing it along said first surface toward said one end so as to induce a secondary fluid surrounding said body to flow along said first surface, and the other of said ports communicating with said passageway between said exit and said one port for conducting some of the pressurized primary fluid out of said passageway via said other port and directing it along said second surface toward said one end to induce more of said secondary fluid surrounding said body and the said fluids flowing along said first surface to merge with the stream of primary fluid discharged from said exit.

15. A nozzle according to claim 14 wherein each of said first and second exterior surfaces is concentric with said passageway and is tapered toward said one end.

16. A nozzle according to claim 15 wherein said first and second exterior surfaces have the same slope and are substantially coincident with one another.

17. A nozzle according to claim 14 wherein said flow inducing means comprises a third surface on said body which is disposed so as to converge toward said passageway away from said exit end, and a fourth transition surface that extends between said first and third exterior surfaces.

18. A nozzle according to claim 17, wherein said flow inducing means further includes a fifth surface on said body which is disposed so as to converge toward said passageway away from said end, and a sixth transition surface that extends between said second exterior surface and said fifth surface.

19. A nozzle according to claim 18 wherein said sixth transition surface is cylindrical.

20. A nozzle according to claim 18 including means cooperating with said sixth transitional surface to form an orifice between said first and second surfaces.

21. A nozzle according to claim 14 including a fluid-permeable element in said passageway between said exit and said ports.

22. A nozzle according to claim 21 wherein said fluid-permeable element comprises a compressed mass of a wire mesh fabric.

23. An air nozzle comprising:

a body including an interior elongated passageway having at one end thereof an entrance for admitting pressurized primary fluid and at the other end thereof an exit for discharging said primary fluid;

at least one port providing an opening between the exterior of said body and said passageway at a point intermediate said entrance and exit;

means for creating sufficient back pressure to force some of the pressurized primary fluid to flow out of said passageway via said at least one port;

a surface on the exterior of said body which converges with said passageway toward said exit; and means for directing pressurized primary fluid conducted out of said at least one port along said surface toward said exit so as to induce secondary fluid surrounding said body to flow and merge with the primary fluid discharged from said exit.

* * * * *

UNITED STATES PATENT AND TRADEMARK OFFICE

CERTIFICATE OF CORRECTION

PATENT NO. : 3,984,054

DATED : October 5, 1976

INVENTOR(S) : Alain Frochaux

It is certified that error appears in the above–identified patent and that said Letters Patent are hereby corrected as shown below:

Column 5, Line 66: Delete the word "to" and substitute therefor the word "and"

Signed and Sealed this

Fourteenth Day of December 1976

[SEAL]

*Attest:*

RUTH C. MASON
*Attesting Officer*

C. MARSHALL DANN
*Commissioner of Patents and Trademarks*